US005480042A

United States Patent [19]

Engle

[11] Patent Number: 5,480,042

[45] Date of Patent: Jan. 2, 1996

[54] LOCK AND COUPLER FOR A RAILWAY RAMP CAR HAVING FLUID AND ELECTRICAL COUPLINGS

[75] Inventor: Thomas H. Engle, Cape Vincent, N.Y.

[73] Assignee: Knorr Brake Holding Corporation, Westminster, Md.

[21] Appl. No.: 412,581

[22] Filed: Mar. 29, 1995

Related U.S. Application Data

[63] Continuation of Ser. No. 177,150, Jan. 4, 1994, Pat. No. 5,445,083.

[51] Int. Cl.[6] ..... B61G 5/08; B61G 5/10; B61D 47/00

[52] U.S. Cl. ..... 213/1.3; 213/75 R; 213/76; 213/189; 105/238.1; 105/355; 105/422; 105/454; 280/421; 280/422; 280/785; 137/347; 137/348; 137/614.04; 285/25; 439/191

[58] Field of Search ..... 105/3, 4.1, 159, 105/238.1, 355, 422, 454; 213/1.3, 2, 3, 75 R, 76, 188, 189; 280/401, 421, 422, 785; 410/56; 414/335, 349, 469, 480, 481, 498; 137/347, 348, 614.04; 285/25, 26, 28, 29; 439/190, 191, 195, 197

[56] References Cited

U.S. PATENT DOCUMENTS

| | | | |
|---|---|---|---|
| 4,405,271 | 9/1983 | Adams | 410/53 |
| 4,702,291 | 10/1987 | Engle | 105/35 |
| 4,784,066 | 11/1988 | Ellis | 105/4.1 |
| 5,020,445 | 6/1991 | Adams, Jr. | 105/4.1 |
| 5,222,443 | 6/1993 | Engle | 105/355 |

*Primary Examiner*—Robert J. Oberleitner
*Assistant Examiner*—S. Joseph Morano
*Attorney, Agent, or Firm*—Barnes & Thornburg

[57] ABSTRACT

A retainer is provided for retaining a catch mounted to a first portion of a split ramp car in its unlocked position as a second portion of a ramp car exits a locking area in which it is previously locked. An arm portion of the retainer extends into the locking area and controls the operation of the retainer in response to the movement of the ramp and the locking area. A fluid coupler, automatically couples a first and second portions of a main reservoir pipe and a first and second portions of a brake pipe connected to each first and second portion of the ramp car respectively, when the ramp is in its raised and travel position. Valves in each of the main reservoir passages close the main reservoir passage when the first and second housings are separated and opens the main reservoir passages when the first and second housings are joined. An electrical coupler is also automatically coupled as the two portions of the ramp car are joined. The fluid and the electrical coupler are mounted to the respective portions of the ramp car so as to be aligned and adjust themselves with respect to the ramp car during mating.

14 Claims, 11 Drawing Sheets

LOCK AND COUPLER FOR A RAILWAY RAMP CAR HAVING FLUID AND ELECTRICAL COUPLINGS

This is a continuation of application Ser. No. 08/177,150, filed Jan. 4, 1994, now U.S. Pat. No. 5,445,083.

BACKGROUND AND SUMMARY OF THE INVENTION

The present invention relates generally to intermodal trains for transporting over-the-road vehicles or loads and more specifically to a lock and coupler for a ramp car for such trains.

The design of special cars to be used in a railroad system to carry containers or trucks or truck trailers has generally been modification of existing railroad stock. These systems have not been designed to accommodate for the specific loads thus, have not taken advantage of these lighter loads. The economy and operation as well as original material were not taken into account.

An integral train is a train made up of a number of subtrains called elements. Each element consists of one or two power cabs (locomotives) and a fixed number of cars. A typical example is illustrated in U.S. Pat. No. 4,702,291 to Engle. A complete train would consist of a number of elements. The elements could be rapidly and automatically connected together to form a single train. It is expected that in certain cases elements would be dispatched to pick up cargo and then brought together to form a single train. The cargo could then be transported to the destination and the elements separated. Each element could then deliver its cargo to the desired location. Each element would be able to function as a separate train or as a portion of a complete train. The complete train could be controlled from any element in the train. The most likely place for control would be the element at the head end of the train, but it was anticipated that under circumstances such as a failure in the leading unit, the train would be controlled from a following element.

The elements themselves may be as long as 1,000 feet long with each of the cars being 28 feet long. The loading and unloading of trailers onto and from the cars have generally required a concrete deck at the height of the car. Thus the elements generally are limited to be unloaded at special dock platforms.

A ramp car designed for trains which allows loading and unloading of trucks from a train at any location and is described in U.S. Pat. No. 5,222,443. The ramp car includes two ramps split in half when the two ramp portions are moved relative to each other. The original disclosed lock mechanism did not assure that the locking pin or bolts is maintained in its unlocked position until the lower ramp is removed from the recess or locking area and maintained out of the locking area until the lower ramp is inserted. Because the ramp car's pneumatic control lines may be disconnected before the interlock plate moves into position, the pin may fall into the locking area prematurely. Also there is no automatic coupling and decoupling of the fluid control lines and the electrical control lines running through out the train when the ramp car was assembled and disassembled.

Thus, it is an object of the present invention to provide an improved locking mechanism which insures that the locking element or latch is maintained in an unlocked position as the lower ramp is removed therefrom.

Another object of the present invention is to provide automatic couplers for the fluid and electrical controls in the ramp car.

These and other objects are achieved by providing a retainer for retaining a catch, which is received in a catch aperture to lock the ramp in a locking area, in the catch unlocking position while the ramp exits the locking area. This is independent of air pressure. The retainer in two embodiments includes a catch edge on the catch, a latch for engaging the catch edge and an arm connected to the latch and having an end in the locking area for disengaging the latch from the catch edge in response to the movement of the ramp in the locking area. In one embodiment, a catch plate in the locking area receives the catch as the ramp exits the locking area. The catch plate engages the arm of the latch to disengage the latch from the catch edge as the ramp is exiting the locking area. In a second embodiment the latch may be configured such that the ramp engages the arm of the latch to disengage the latch from the catch edge as the ramp enters the locking area. The second latch embodiment includes two jaws wherein a first jaw engages the catch when the catch is moved into an unlocked position and the ramp is in the slide. The second jaw engages the catch edge when the ramp exits the locking area and the second jaw disengages the catch edge as the ramp enters the locking area and allows the catch to enter the latch apertum.

The retainer can also be described as including a pivoted arm having an end in the locking area for engaging the ramp. In a first position of the arm, the retainer retains the catch in the unlocked position as the ramp exits the locking area. In a second angular position of the arm, the retainer permits the catch to enter the catch aperture as the ramp enters the locking area. For the previously described two jaw retainer, the first jaw engages and retains the catch when the catch is moved into the unlocking position and the arm is in the second position. The second jaw engages and retains the catch when the arms is in the first position and disengages the catch when the arm is in the second position. For the two jaw embodiment, the arm of the retainer is pivotally connected to the ramp car and the first jaw is pivotally connected to the combined arm and second jaw. A third embodiment of the retainer includes an arm pivotally connected to the catch, the arm rides on and maintains the first position as the ramp exits the locking area. The arm is moved into the second position by the entry of the ramp into the locking area to allow the catch to enter the catch aperture when they are aligned.

A fluid coupler including first and second housings connected to a respective first and second ramp car portion, automatically couples a first and second portion of a main reservoir pipe and a first and second portion of a brake pipe. A main reservoir coupling port and a brake coupling port in each of the housings are connected by a passage to a main reservoir pipe port and brake pipe port. An actuator responsive to the positions of the first and second housings relative to each other closes valves in each of the main reservoir passages when the first and second housings are separated and opens the valve when the first and second housings are joined. The main reservoir coupling ports each include a coupler resiliently mounted therein for mating with a respective coupler and the actuators are connected to the coupler so as to operate the valve, as a function of the position of the coupler in the main reservoir coupling port. A spring is provided as part of the valve for closing the valve and also forms part of the resilient mounting of the coupler in the coupling port. The brake coupling port also includes a coupler resiliently mounted thereto for mating with the respective coupler.

An electrical coupler, for the electrical cable running throughout the train, automatically couples the first portion of the electrical cable on a the first ramp car portion to a second portion of the electrical cable on the second ramp car portion when the ramp is in its raised travel position. The fluid and electrical couplers include alignment elements for aligning the first and second housings during mating along the mating axis. The first housing is mounted to the first ramp car portion so as to allow movement of the first housing along the mating axis. The second housing portion is mounted to the second ramp car portion so as to allow movement of the second housing transverse the mating axis to facilitate alignment.

Other objects, advantages and novel features of the present invention will become apparent from the following detailed description of the invention when considered in conjunction with the accompanying drawings.

BEST MODES OF CARRYING OUT THE INVENTION

Figure 1:
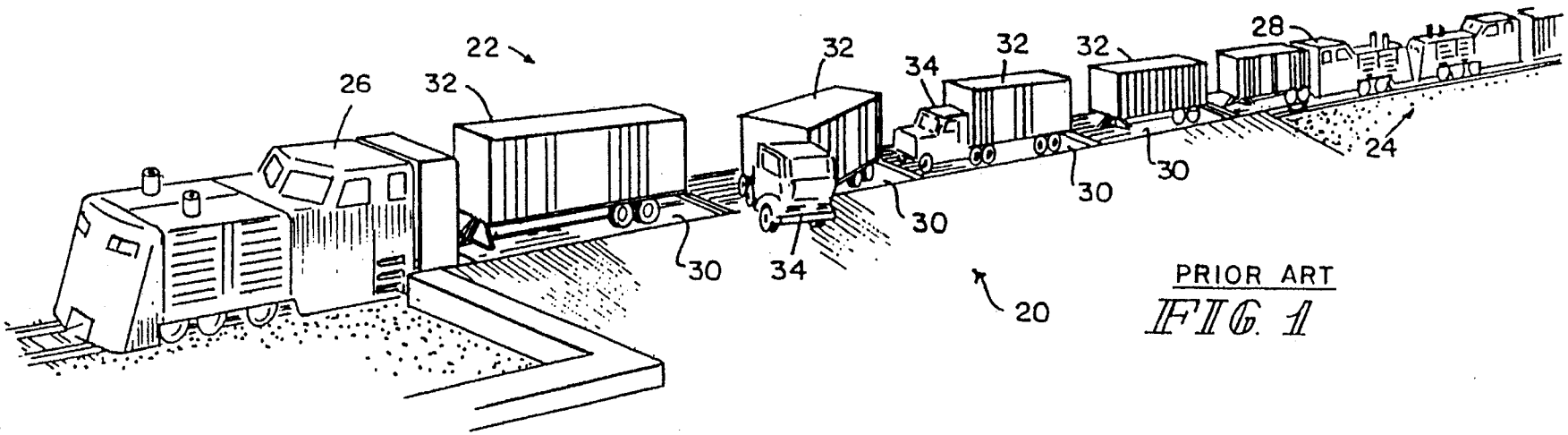
PRIOR ART FIG. 1
FIG. 1 is a perspective view of an integral train.

A typical integral train is illustrated in FIG. 1 and is described in detail in U.S. Pat. No. 4,702,291 which is incorporated herein by reference.

As illustrated in FIG. 1, a train 20 includes a plurality of train sections 22 and 24 which represent one of a plurality of train sections. Each section includes a pair of control cabs 26 and 28 at each end of the section. Note that conventional locomotives could be used at these locations. One of the control cabs is considered the master while the other is the slave and are interconnected to provide the appropriate control of the propulsion and braking system. Connected between the two control cabs 26 and 28 is a plurality of cars 30 forming a continuous deck. The deck is structured such that loads for example, trailers 32 may be secured to the cars 30 on a specific car or across the juncture of a pair of cars. The trailers 32 may be secured by themselves or in combination with the truck caps 34. By providing a continuous decking, the train 20 can be side loaded from a flush platform. This allows simultaneous loading of trucks, thus eliminating the necessity to wait for a loading crane.

Figures 9, 11:
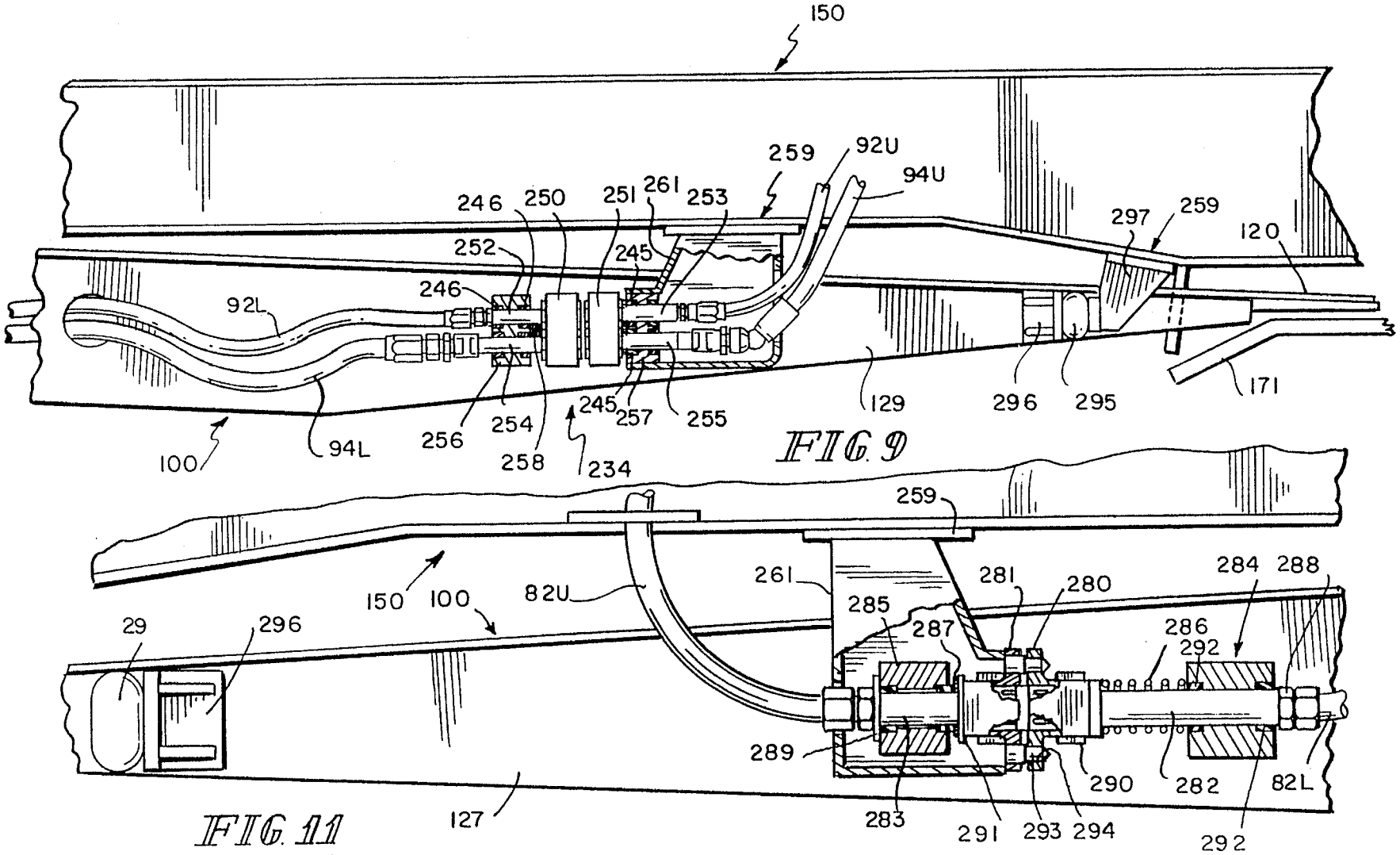
FIG. 9 is a partial side view of a ramp car having a fluid coupler according to the principles of the present invention.
FIG. 11 is a partial side view of a ramp car having an electrical coupler according to the principles of the present invention.

A microprocessor controller is connected throughout the train element to each of the individual cars 30 and to the microprocessor controller in the other cab, which forms a train element, by a coaxial cable serial bus 82, shown in FIG. 11. A brake status and control unit is connected electrically to the microprocessor and fluidically to main reservoir pipe 92 and brake pipe 94, shown in FIGS. 9 and 10, which run through the train.

By providing a control cab at each end of an element facing in opposite directions, a train can be made up from individual elements without concern as to the direction the element is headed. As an alternative, the element may be direction specific with a powered control cab at one end and a powerless control cab or module at the other end. The powerless control cab would contain the same electronics and control hardware as the powered control cab except for interface to an operator and controls and sensors for the propulsion system.

A ramp car for the train elements would be positioned in the center of the 1,000 foot element. It includes a pair of ramps mounted to a respective wheel set. Depending upon the structure of the train element, each ramp would be mounted to an individual wheel set which is connected to the remainder of the train elements or as described in the previously discussed patent, would be a car having a single wheel set with its unwheel end connected to the wheel set of an adjacent car. As even a further alternative, the ramps themselves may be mounted to wheel sets of adjacent cars and include no separate distinct wheel set.

The details of the ramp car are illustrated in FIGS. 2A, 2B, 3 and 4. Those elements having the same purpose and function as the ramp car described in U.S. Pat. No. 5,222,443, which is incorporated herein by reference, will have the same reference number. The lower ramp 100 includes a pair of ears 102 for pivotal connection to a wheel set 105 and a neck 104 with a hole to receive a pin of the wheel set 105. Upper ramp 150 has an equivalent pair of ears 152 and neck 154. A wheel set has not been shown in FIG. 2B for the upper ramp 150 as an example of the design of the ramp car for use in the integral train of U.S. Pat. No. 4,702,291 wherein only one wheel set is used per car. In this example, the upper ramp 150 is mounted to the wheel set of the adjacent car.

A guide plate 106 is attached on the two lateral sides of the lower ramp 100 and act as a guide for the lateral sides 156 of the upper ramp 150. Two pairs of channels 108 and the top surface of the lower ramp 100 receives respectfully a beam 158 of the upper ramp 150. The leading lower edge 110 of bottom ramp 100 and 160 of upper ramp 150 are truncated to form an angle which will be parallel to the surface of which the ramps can engage when the ramps are in their lowered loading position. The lower ramp 100 includes a pair of rollers 112 adjacent leading edge, and upper ramp 150 includes a pair of rollers 162 adjacent its leading edge. Both the rollers support the leading edge of the ramps as they move across the ground or a rail road track, which is preferred. The roller 162 of the upper ramp 150 will also ride on the top surface of the lower ramp 100. The lower leading edge of the upper ramp 150 includes a wear plate 163 ahead of the rollers 162.

Figure 4:
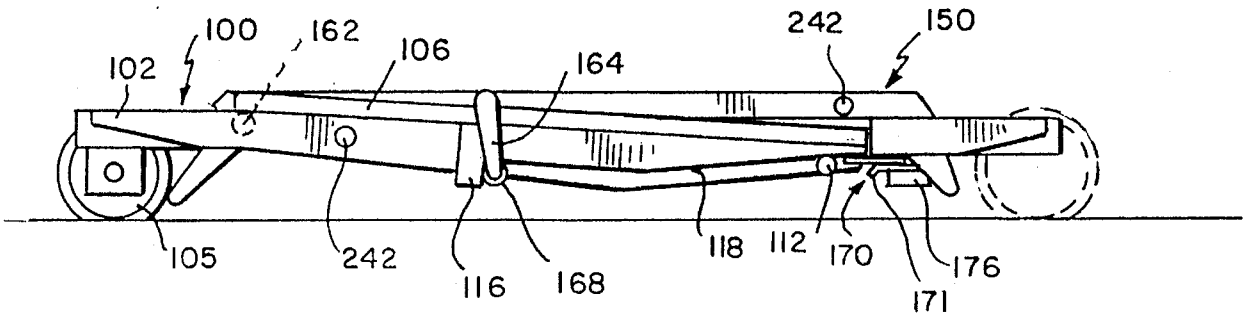
FIG. 4 is a side view of the ramp car of FIGS. 2A and 2B in its raised travel position.
Figure 3:
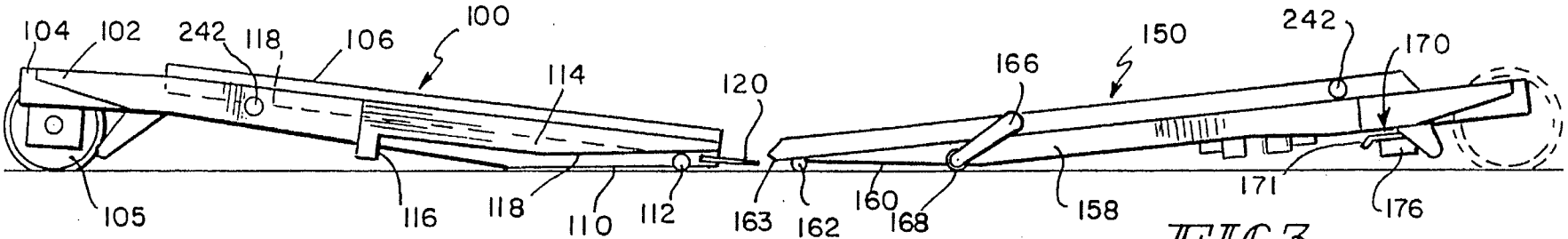
FIG. 3 is a side view of the ramp car of FIGS. 2A and 2B in its lowered loading position.

The ramp 150 includes a pair of guides having an arm 164 pivotally connected at 166 to the exterior edge of the upper ramp 150. A roller 168 extends from the lower end of the arm 164. The lower ramp 100 includes a guide plate 114 attached to the sides that includes a lower guide or cam surface 118 and a stop 116. The roller 168 of the upper ramp 150 will ride on the cam surface 118 and come to rest against stop 116 when the two ramps are joined in their raised travel position, as illustrated in FIG. 4. Although only one pair of guide arms 164 are shown, other pairs may be provided along the length of the upper ramp. Also, the guide arms 64 may be provided on the lower ramp 100 extending up instead of the cam surface provided on the upper ramp 150. In a preferred embodiment, the guide plate 114 with cam surface 118 and stop 116 and guide arms 164 are positioned on interior beams 127 and 129 of lower ramp 100 and interior beams 157 and 159 of upper ramp 150 respectively.

Figure 5A:
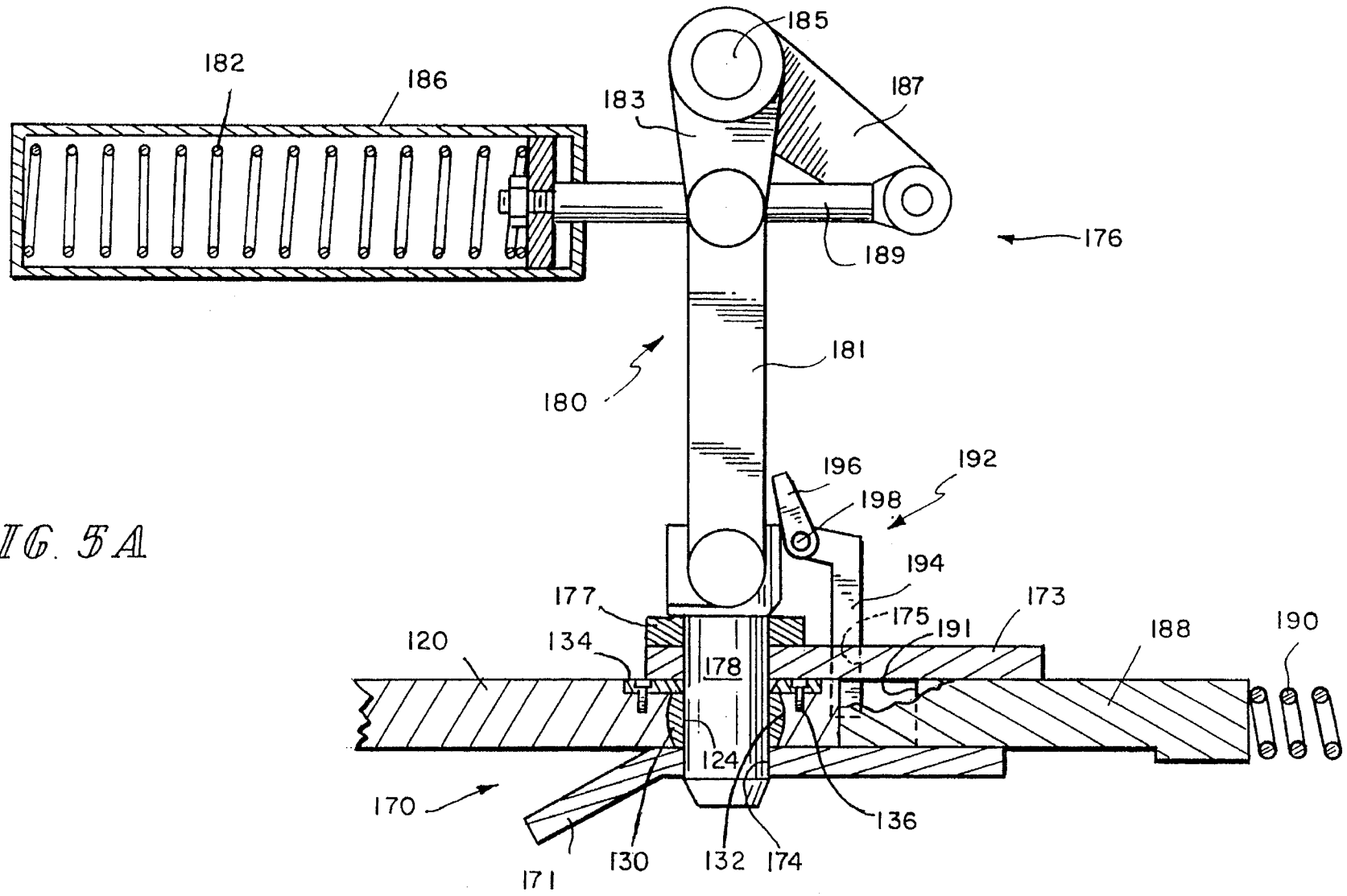
FIGS. 5A through 5C are cut-away views which illustrate the sequence of a first embodiment of the locking mechanism incorporating the principles of the present invention from the locked FIG. 5A position to the unlocked and latched FIG. 5B position to the unlatched FIG. 5C position.
Figure 5B:
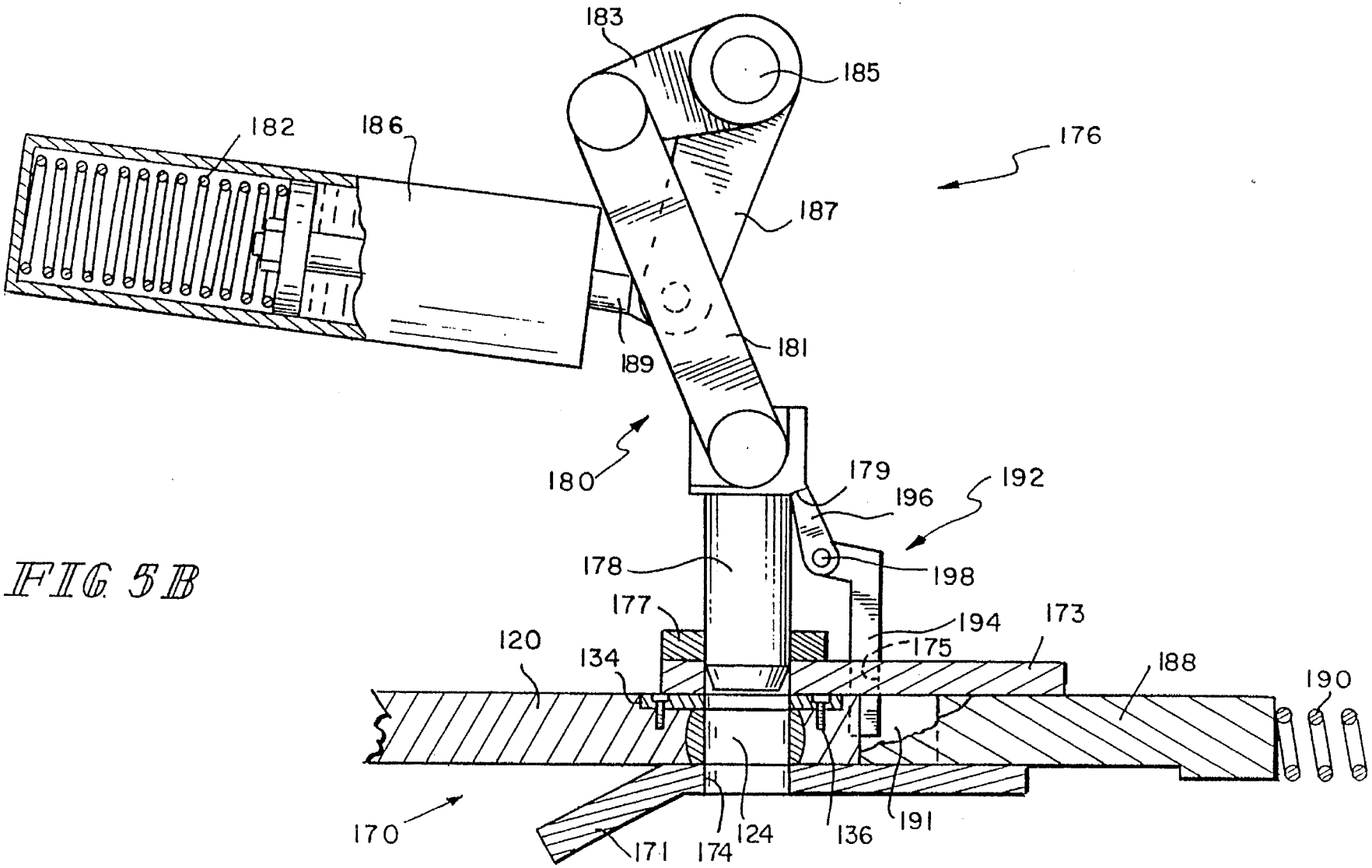
Figure 5C:
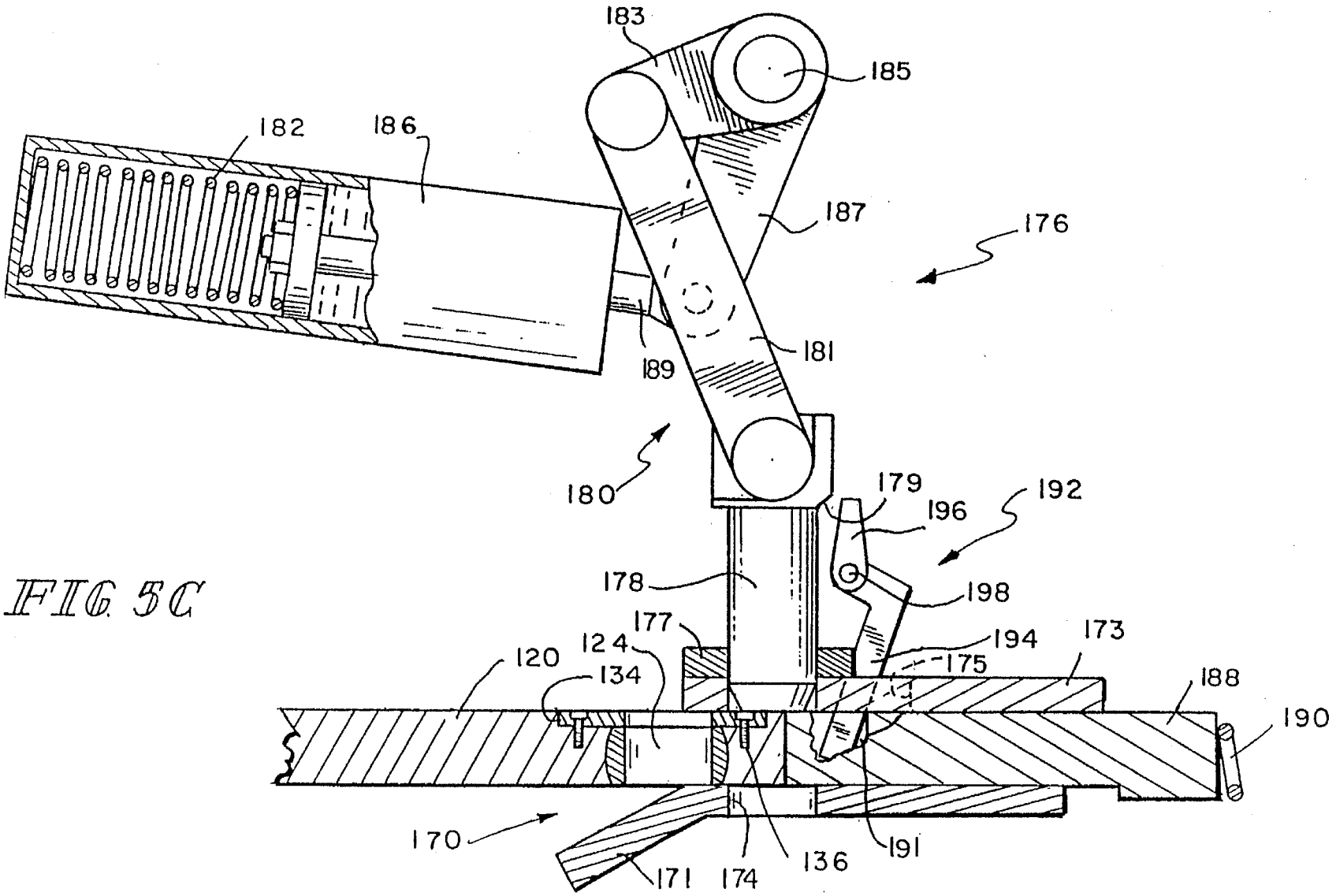

A locking mechanism includes a tongue portion 120 on the center leading edge of the lower ramp 100 having a pair of alignment slots 122 and a catch aperture 124 to receive, for example, a catch bolt, pin or hook. The upper ramp 150 along its bottom surface includes a locking area 170 shown as a recess to receive the leading edge of tongue 120 of the lower ramp. Depending on the locking mechanism the locking area may have a top and bottom walls or just a bottom wall. A guide 171 is provided to guide the leading edge of tongue 120 into locking area 170. A pair of guides 172 are provided for the alignment slots 122. A hole 174, which aligns with aperture 124 as shown in FIGS. 5A–5C, receives a catch under the control of locking controller 176. The details of the locking controller 176 will be described with respect to FIGS. 5A through 5C. As will be noted, the preferred embodiment of the locking mechanism of FIGS. 5A–5C has the locking controller 176 on top of the locking area 170. Although the locking mechanism is shown in each of the embodiments as including the catch on the upper ramp and the catch aperture on the lower ramp, these positions can be reversed. It is possible also to provide the catch on the edge of the ramp and the catch aperture on the locking area.

As described in U.S. Pat. No. 5,222,443, the engagement of the lower guide or cam surface 118 of the lower ramp 100 by the roller 168 and arm 164 of the upper ramp 150 controls the raising and lowering of the pair of ramps as they move towards and away from each other respectfully.

The detail of the locking mechanism, as illustrated in FIGS. 5A–5C, includes a catch shown on a bolt 178 to be received in a catch aperture 124 of the tongue 120 of the lower ramp 100 and hole 174 in the upper ramp 150.

The aperture 124 is in a sleeve 130 having a spherical outer surface and received in a spherical opening 132 in the tongue 120. A wear plate 134 of hard material is mounted by fasteners 136 to the tongue 120 and retains the sleeve 130 in the spherical opening 132. The wear plate 134 has a partial spherical interior surface to mate with the exterior spherical surface of the sleeve 130. The spherical configuration of the sleeve and its mating with the tongue 120 allows the sleeve and the aperture 124 to rotate and align itself for any misalignment with respect to the bolt 178. The catch plate 134 and sleeve 130 are made of harder material than the tongue 120 and may be replaceable.

Figure 2B:
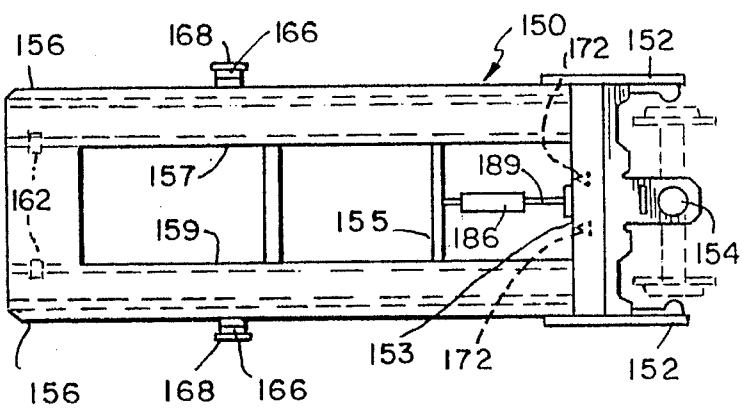
FIGS. 2A and 2B are plan views of a pair of separated ramps of a ramp car incorporating the principles of the present invention.
Figure 2A:
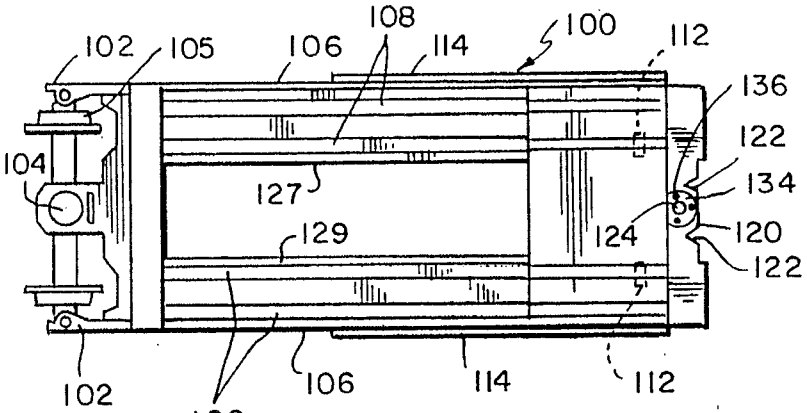

A linkage mechanism 180 interconnects bolt 178 to an operator or driver 186, shown as a fluid cylinder. The fluid cylinder 186 is operated in one direction by fluid to move the bolt 178 to the unlocked position of FIG. 5B and has a return spring 182 to move the bolt 178 to its locked position of FIG. 5A. The operator 186 is connected to the beam 155 of the upper ramp 150 shown in FIG. 2B and is controlled by a control device plugged into ports 242 shown in FIGS. 3 and 4. The linkage mechanism 180 includes a first link 181 connected to the bolt 178 and to a link 183 which is mounted to shaft 185. A link 187 connects piston rod 189 of the fluid cylinder 186 to shaft 185. The links 183 and 187 are spaced along the shaft 185 which is mounted to beam 153 of the upper ramp 150 as shown in FIG. 2B.

An interlock or catch plate 188 slides in locking area 170 and is biased to its extended position illustrated in FIG. 5C by a spring 190. The catch plate 188 retains the bolt 178 in its retracted position as illustrated in FIG. 5C. When the tongue 120 of the ramp enters locking area 170, it engages catch plate 188 and drives it back to the right. The bolt 178 rides on the surface of the tongue 120 and wear plate 134 until the catch aperture 124 is aligned with the bolt 178. Depending upon the condition of the latch 192, the bolt 178 will then enter catch aperture 174 driven by spring 182. The lock condition is illustrated in FIG. 5A.

A retaining mechanism 192 includes an arm 194 extending down into .locking area 170 and includes a latch 196. The arm 194 and latch 196 are connected to shaft 198. The latch 196 is received and catches a shoulder or catch edge 179 on the bolt 178 as illustrated in FIG. 5B for a first angular position of the arm 194. Preferably, the mating surface of latch 196 and the catch edge 179 are perpendicular to the axis of the arm of latch 196 and at an angle to the axis of bolt 178 so as to minimize the force required to move the latch 196 from engagement with catch edge 179. The retainer 192 is forced into its latching position by spring, not shown, causing counterclockwise rotation of the shaft 198. The arm 194 is free to move in slot 175 of plate 173 and in slot 191 in catch plate 188 as long as the catch plate 188 is out of the path of travel of the bolt 178 as illustrated in FIGS. 5A and 5B. This position of the catch plate is an indication that the tongue 120 of lower ramp 100 is in its raised traveling position. If the bolt 178 has been raised to its unlocked position by the fluid operator 186, the latch 196 will engage the shoulder 179 and hold the bolt 178 in its unlocked position as illustrated in FIG. 5B for the first angular position of the arm 194. The latch 196 will remain in contact with the shoulder 179 until the catch plate 188 engages the rear of arm 194 by the rear wall of slot 191 in the catch plate 188. This rotates the latch 192 clockwise disengaging the latch 196 from shoulder 179 for a second angular position of the arm 194.

The slot 191 in the catch plate 188 is displaced from the catch aperture 124 transverse to the longitudinal axis of the locking area 170. Thus, the bolt 178 in FIG. 5C engages the surface of catch plate 188 even though it would appear in FIG. 5C that it will enter the slot 191. The length of the slot 191 is selected such that the catch plate 188 is under or in the path of the bolt 178 as illustrated in FIG. 5C before it engages the arm 194. The provision of the retainer 192 assures that the bolt 178 is maintained in an unlocked position until the catch plate 188 is in its path of travel. Thus, the downward movement of the bolt 178 in response to the spring 182 is not dependent upon the timing of the release of the fluid pressure in the fluid cylinder 186. Since the latch 196 has been released and bolt 178 sits on catch plate 188, reinsertion of the tongue 120 of the lower ramp into locking area 170 will move catch plate 188 to the right allowing the spring 182 to drive the bolt 178 into catch aperture 124 once it is aligned with the path of the bolt 178 as illustrated in FIG. 5A. In the locked position the shoulder 179 rests on stop 177.

The locking mechanism 176 of FIGS. 5, by using a bolt 178 as the catch in a circular catch aperture 124, limits horizontal movement between the upper and lower ramps, especially in response to slack forces. Also, the bolt 178 extending through three apertures offers a large surface experiencing horizontal shear forces. The linkage 180 being in-line in the lock position also prevents the lock from becoming unlocked in response to forces throughout the car. The limitations of the embodiment of FIGS. 5 are that it requires longitudinal as well as lateral alignment of the catch with the catch aperture. A second and a third embodiment of the locking mechanism requires less alignment while still providing a lock which will not unlock in response to forces and maintains the upper and lower ramps substantially motionless with respect to each other in response to slack forces.

Figure 6:
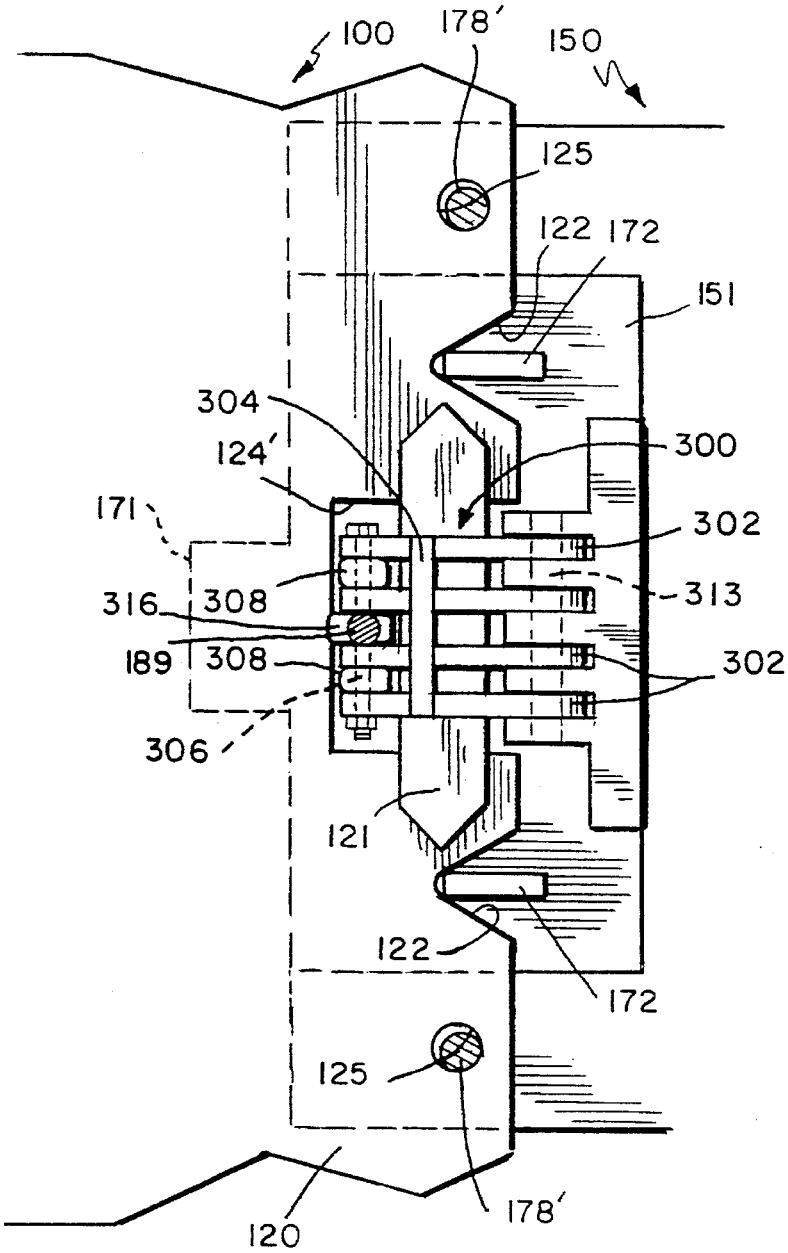
FIG. 6 is a cut-away plan view of a second embodiment of the locking mechanism incorporating the principles of the present invention.

This embodiment is illustrated in FIG. 6 and 7A through 7D. The catch aperture 124' is shown in FIG. 6 as an elongated opening having a wear plate 121 forming one side thereof. The catch of the second and third embodiments are illustrated as a hook 300 having a plurality of hook shaped fingers 302 joined together by a welded bar 304. A rod 306 extends through the heads of the fingers 302 and spacers 308. The driver or cylinder 186 has its rod 189 directly connected to the hook 300 by pin 306. The other end of the driver 186 is connected to beam 153 by bracket 310. The fingers 302 of the hook 300 have an arch surface 312 which matches the arch surface 123 of the wear plate 121. A pin 313 pivotally connects the other end of the fingers 302 to a mounting block 151 on the upper ramp 150. The center of the matching arch surfaces 123 and 312 are centered at the pivotal connection 313 and they are made at the locked position of FIG. 7A, below the center of 313. This helps prevent the unlocking of the joined surfaces 123 and 312 in response to slack and other select forces.

By using a plurality of hook fingers 302, a maximum amount of contact surface between the hook surface 312 and the wear plate surface 123 is provided. This maximizes the amount of shear surface without unduly increasing the amount of material used. Use of the elongated opening 124' in combination with the hook 300 allows lateral misalignment with self longitudinal alignment. The hook 300 prevents longitudinal motion after it is locked.

The retaining mechanism of FIGS. 6 and 7 is merely a simple arm 314 pivotally connected at 316 to the hook 300. One arm 314 may be provided on each lateral side of the combined hook 300. The arm 314 is responsive to the position of the tongue 120 of the lower ramp 100 to perform the function of maintaining the unlocked hook 300 in an unlocked position as the tongue 120 is removed from the locking area 170 and to allow the hook 300 to lock when the tongue 120 into the locking area 170. In the locked position illustrated in FIG. 7A, the hook 300 has its arch surface 312 mated with arch surface 123 of the wear plate 121. The arm 314 is in a lowered or a second angular position resting on the wear plate 121.

Figure 7A:
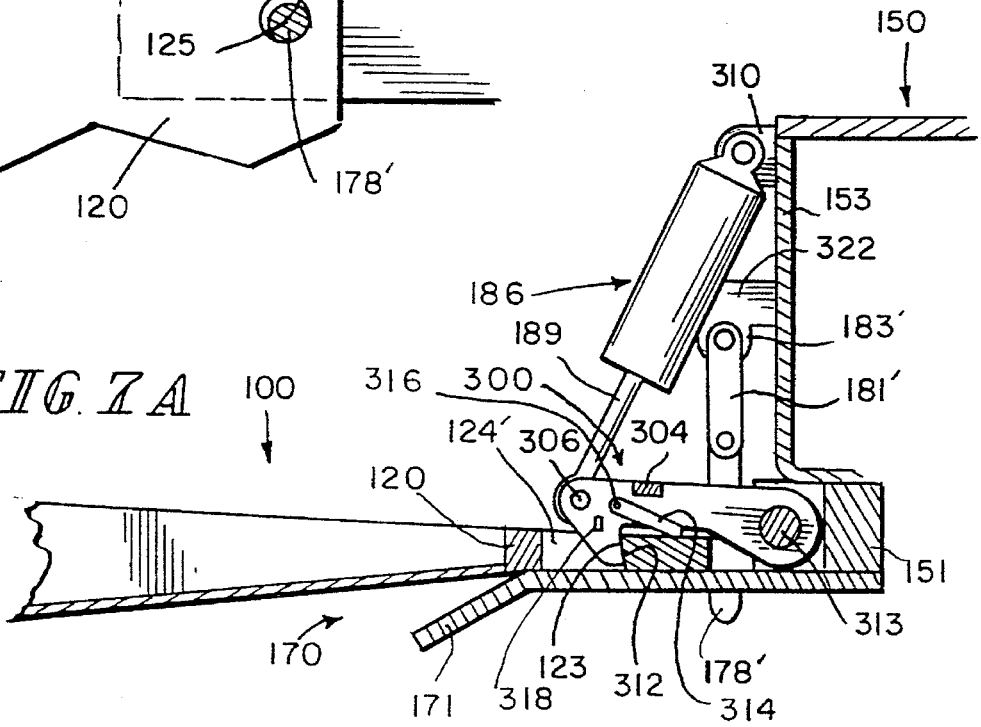
FIGS. 7A through 7D are partial side views taking along lines VII–VIII of FIG. 6 illustrating the sequence of a second embodiment of the locking mechanism from its lock in FIG. 5A position to the unlocked and latched FIG. 5B position to the latched FIG. 5C position, and to the unlatched FIG. 7D position.
Figure 7B:
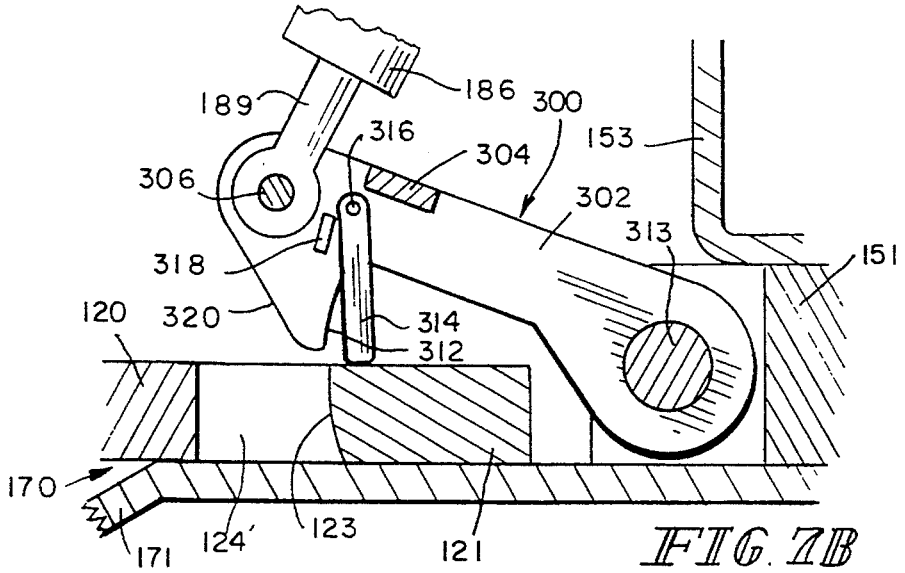
Figure 7C:
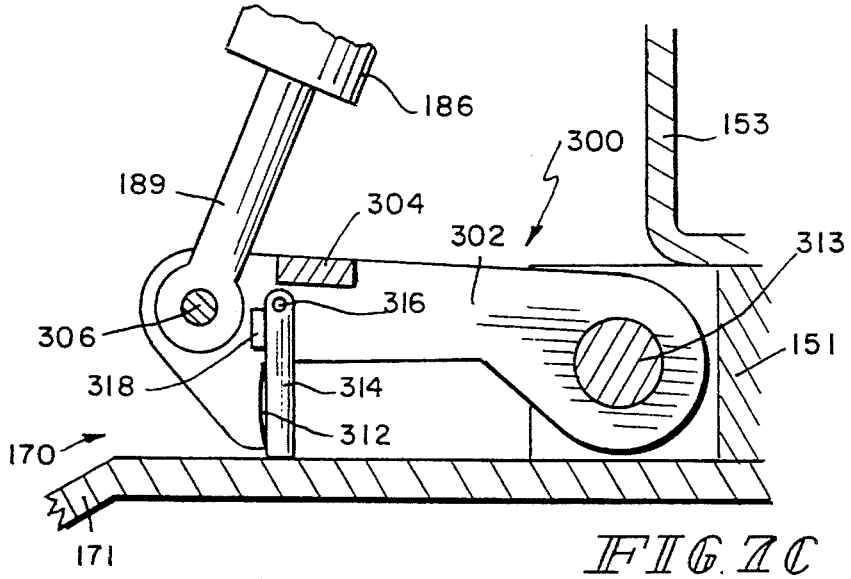

When the driver 186 is actuated to move the hook 300 to its unlocked position as illustrated in FIG. 7B, the arm 314 rotates down under the force of gravity to a substantially vertical or first angular position and rests on wear plate 121. Upon release of pressure from the driver 186, the arm 314 retains the hook 302 in its unlocked position. A stop 318 on the finger 302 prevents the arm 314 from rotating past its vertical position. As the ramps are separated and the tongue 120 leaves a locking area 170, the arm 314 rides on the top of wear plate 121 and maintains the hook 300 in its unlock position. Once the tongue 120 has exited the locking area 170, the hook 300 rotates down with the arm 314 engaging the bottom wall of the locking area 170 as illustrated in FIG. 7C. The arm 314 is sufficiently long to maintain the hook 300 off the lower wall of the locking area 170.

Figure 7D:
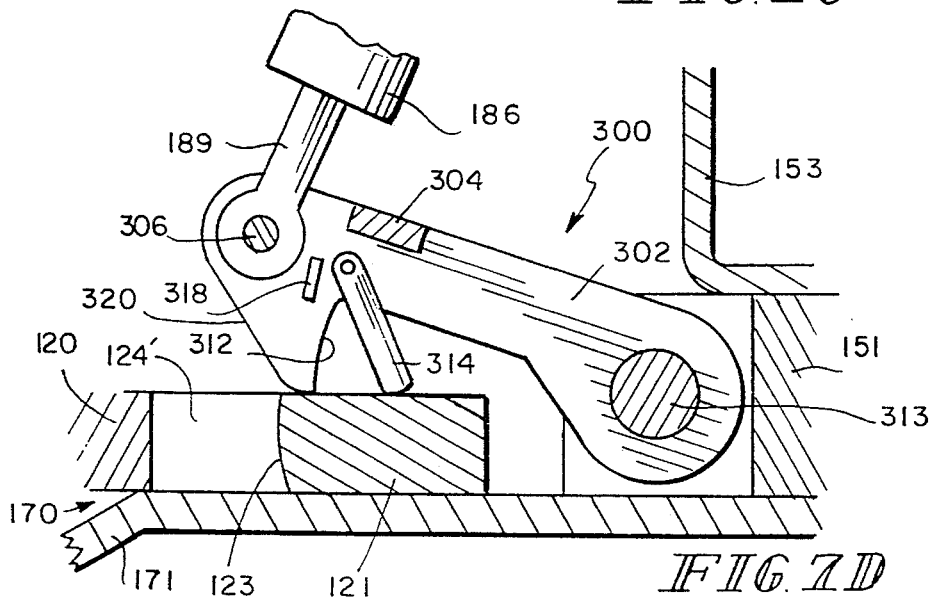

As the ramps are being rejoined, the tongue 120 enters the locking area 170 and engaged the sloped leading surface 320 of the hook 300. This causes the hooks to rotate up and allowing the tongue 120 to engage the arm 314. Hook 300 and the arm 314 ride along the wear plate 121, in another second angular position as illustrated in FIG. 7D. This moves the arm 314 from its retained position and allows the hook 300 to fall into its locking position once the leading edge or surface 123 of catch aperture 124' becomes aligned with the edge or surface 312 of the hooks 300. The hooks will then rotate downward and assume the locked position illustrated in FIG. 7A.

Thus it can be seen that the hook 300 provides an automatic locking of the lower ramp into the upper ramp by insertion into the locking area 170. The arm 314 provides a retaining function to maintain the hook 300 in its unlocked position until the lower ramp is fully removed from the locking area 170. Since the driver 186 is connected directly to the hook or catch 370, the use of linkage to prevent the catch 300 from moving upward is not provided. This locking feature has been provided by using the pin 178', and linkages 181', 183', illustrated only in FIG. 7A. Bracket 322 mounts the pivot of linkage 183 prime to the beam 153. An operator mechanically rotates the linkages externally once the ramp car has been automatically brought together. A limit switch may sense that pin 178 is in its locked position and act as safeguard to prevent the train from moving above a minimum speed, for example 5 miles per hour, until this manual lock is in place. A pair of enlarged catch apertures 125 are provided on each side of the center opening 124'. These holes can be oversized such that alignment is not critical since the longitudinal motion is being limited by the hook latch 300. Shear forces are not being absorbed by the pin 178' which only offers a back-up in case the hook 300 should become dislodged. As an alternative, the piston 186 can be connected to the hook 300 by the linkage system 180 as illustrated in FIGS. 5. This would eliminate the additional hand operated system illustrated in FIG. 7A.

Another embodiment of the locking mechanism including a lock mechanism along the principles of the embodiment of FIGS. 5 with the hook 300 as the catch and aperture 124 as the catch aperture of FIGS. 7 is illustrated in FIGS. 8.

The retaining mechanism 330 includes an arm 332 extending into the locking area and is responsive to the position of the tongue 120 in the locking area 170. Integral with the arm 332 is a first jaw 334 which is a latch that cooperates with a catch edge on the hooks 302. The top bar 304 will be used as providing the catch edge. A second jaw 336 is pivotally connected to jaw 334 by pin 338 which also connects the retaining mechanism 300 to the beam 153 by a bracket 340. The arm 332 and jaw 334 are biased clockwise by, for example, a spring illustrated by arrow 342. The jaw 336 is biased counterclockwise by, for example, a spring illustrated by arrow 344. A stop 346 on the combined arm 332 and jaw 334 provides a stop for the counterclockwise angular rotation of the jaw 336 with respect to jaw 334. The drive mechanism of FIGS. 5 is illustrated in FIGS. 8, but the direct connection of the mechanism of FIG. 7 may be used. The important feature being that the hook 300 is raised to its unlocked position and is allowed to naturally fall or is biased to its locking position.

Figure 8A:
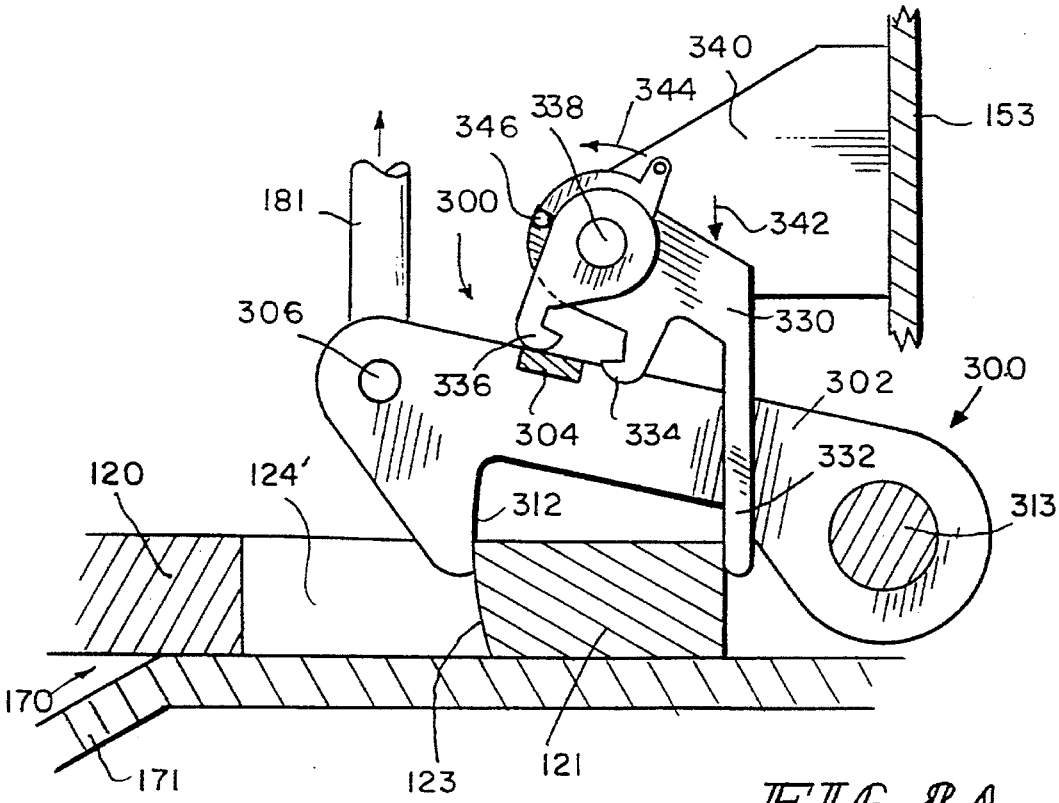
FIGS. 8A through 8D are cut-away views illustrating the sequence of a third embodiment of the latching mechanism incorporating the principles of the present invention from the unlocked and unlatched FIG. 8A position to a first unlocked and latched FIG. 8B position to a second unlocked and latched FIG. 8C position to an unlatched and towards locking FIG. 8D position.
Figure 8B:
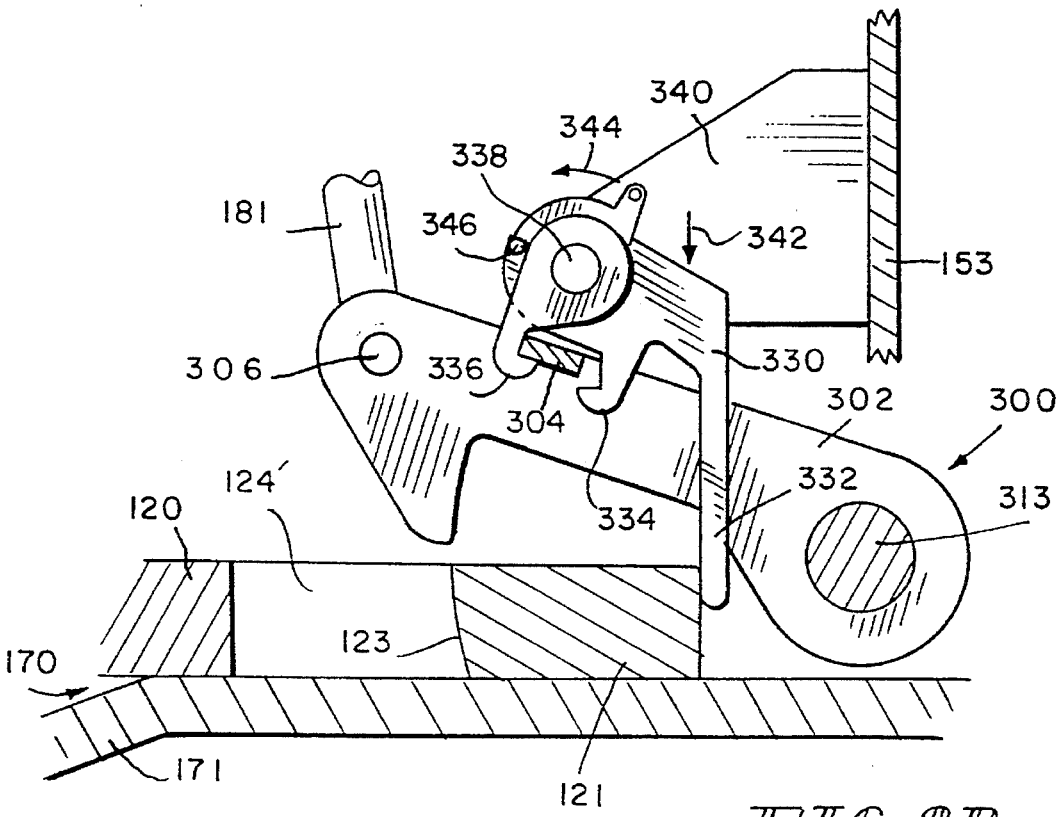
Figure 8C:
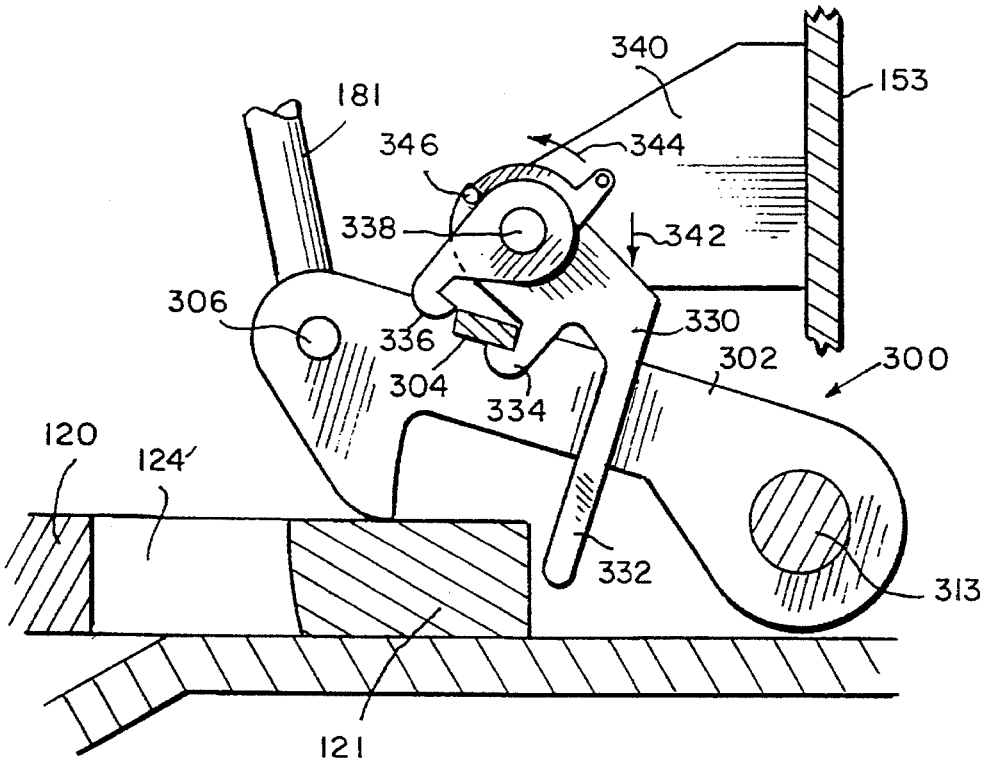
Figure 8D:
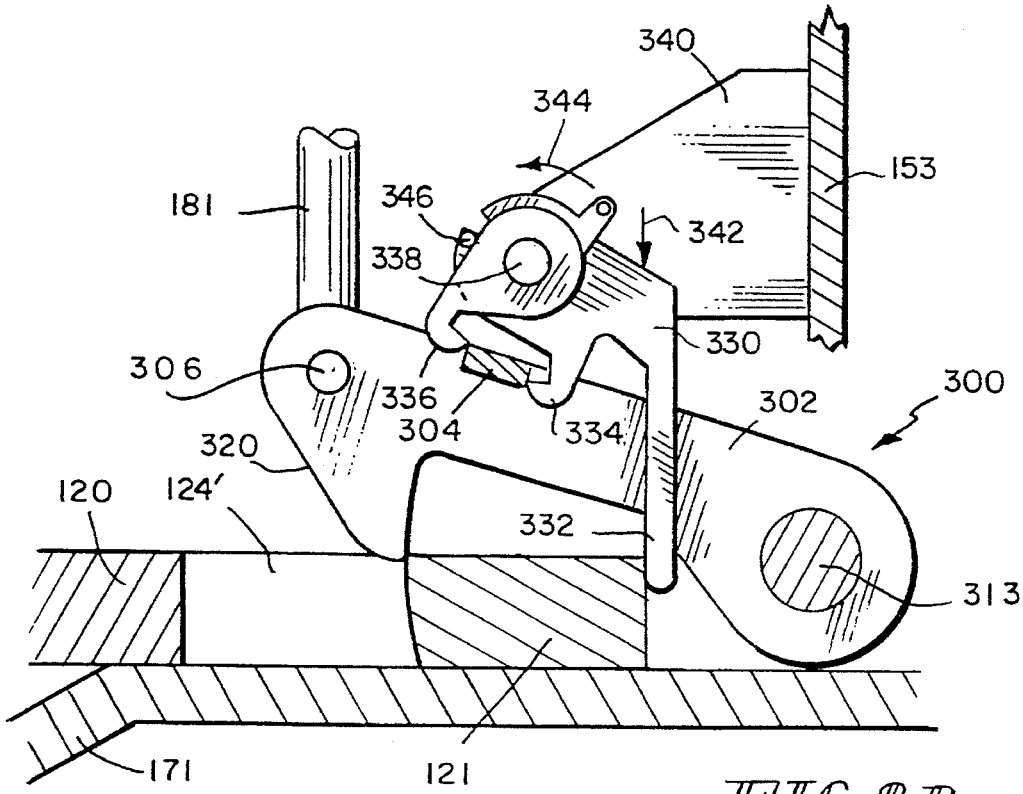

The operation of the retaining mechanism 330 begins by the driver 186, not shown, raising the hook 300. The arm 332 is extended into the locking area 170 in its first angular position allowing the jaw 336 to ultimately catch and retain the hook 300 in its unlocked position. Bar 304, as shown in FIG. 8A, engages the bottom of the hook 336 and forces it to rotate clockwise against spring 334 so as to open and subsequently close as it passes the hook 336 as illustrated in FIG. 8B. The spring 344 rotates the jaw 336 back counterclockwise so as to retain the hook 300 in its unlocked position.

As the ramps are separated from each other, tongue 120 begins to exit the locking area 170 allowing the arm 332 to move towards a second angular position by rotating clockwise under the influence of spring 342. Spring 344 maintains the jaw 336 rotating counterclockwise and against stop 346 such that the jaws 334 and 346 do not move relative to each other as the arm 332 rotates clockwise. The width of the bar 304 is greater than the separation of the inside walls of jaws 334 and 336 such that once the arm 332 has reached an angular position of that illustrated in FIG. 8C, jaw 336 releases the bar 304 allowing the hook 300 to engage and ride on the wear plate 121 on tongue 120. The catch edge of bar 304 does not engage the second jaw 334 as the end of hook 300 rides on the wear plate 121 so as to isolate the retaining mechanism from any vibration of the hook 300. The dimensions of the first jaw 336 and its separation from the second jaw 334 are such that any bouncing or upper movement of hook 300 with the arm 332 in the position illustrated in FIG. 8C that it will not be reengaged by the second hook 336. Once the tongue 120 is fully removed from the locking area 170, the end of hook 300 will not be resting on wear plate 121 and bar 304 will rest on and be caught by the first jaw 334.

Upon reinsertion of the tongue 120 in locking area 170, the wear plate 121 will engage the leading edge 320 of the hook 300 and arm 332 causing arm 332 to rotate counterclockwise against the force of spring 342. As arm 332 rotates back towards the first position, the jaw 334 will rotate faster than jaw 336 can follow, even with the small bias of spring 344. As bar 304 moves down in the gap between jaws 334 and 336, it maintains a separation between jaws 334 and 336 until the bar 304 drops below the edge of the first jaw 334. This allows the hook 300 to fall and be received in catch aperture 124'. After the bar 304 exits the space between the jaws 334 and 336, the light spring 344 closes the gap between spring 334 and 336 such that it assumes the position illustrated in FIG. 8A. Thus it can be seen that the embodiment of FIGS. 8 adapts the catch edge and latch concept of FIGS. 5 to the hook catch of FIGS. 7.

Figure 10:
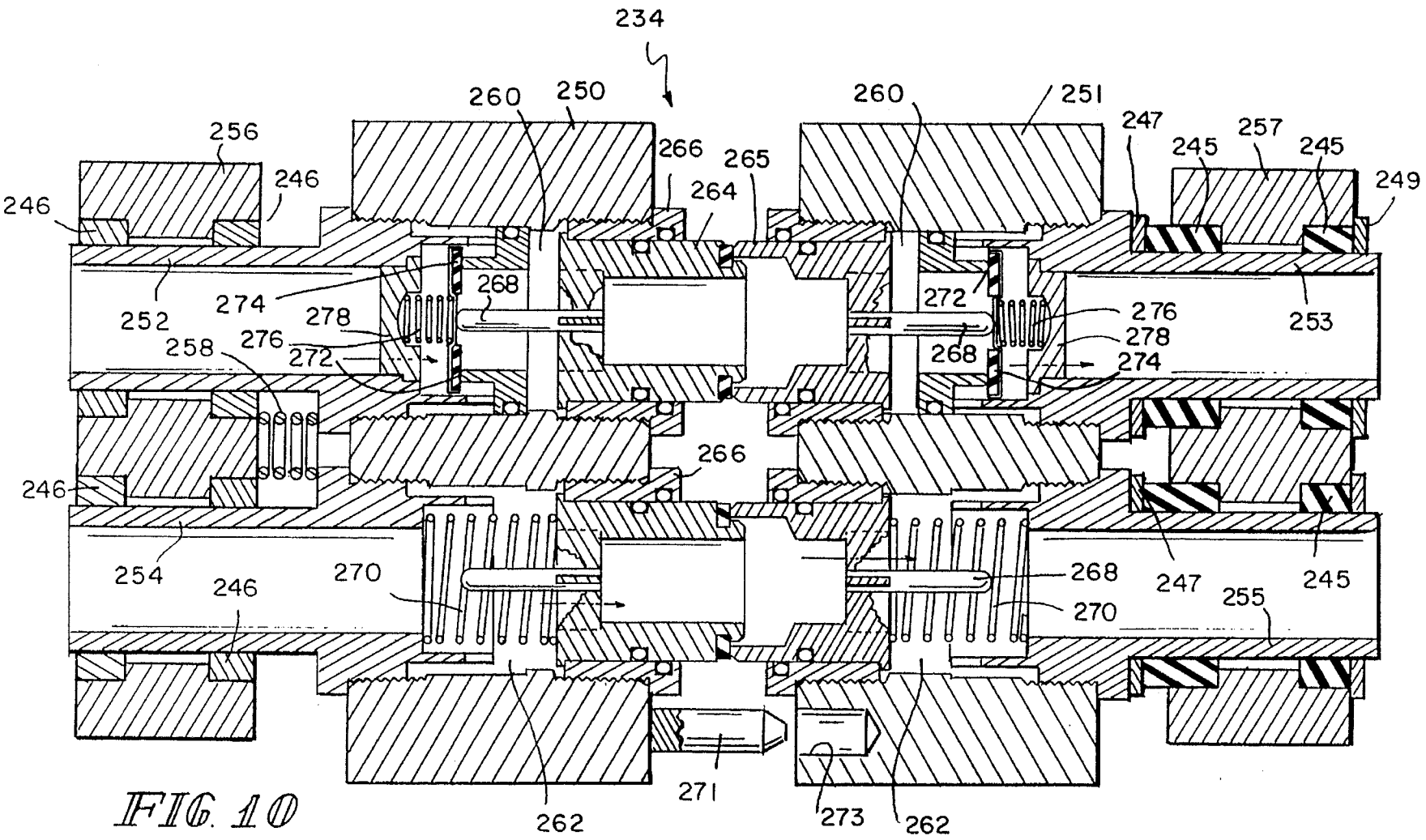
FIG. 10 is a cross-sectional view of a fluid coupler according to the principles of the present invention.

The fluid coupler 234 is illustrated in FIGS. 9 and 10 includes first and second body parts 250 and 251 related to the lower ramp and upper ramp respectively. A main reservoir pipe portions 92L and 92U, for the lower and upper ramp respectively, are connected to the housing portions 250 and 251 by nipples 252 and 253 respectively. The brake pipe portions 94L and 94U of the upper and lower ramp respectively are connected to the housing 250 and 251 by nipples 254 and 255 respectively. The nipples 252 and 254 extend through bracket 256 which mounts the nipples and the housing 250 to the lower ramp at wall 129. A spring 258 biases the coupling and nipples 252 and 254 to extend towards coupling 251 and absorbs some of the coupling forces and over travel. Bushings 246 allow nipples 254 and housing 250 to move longitudinally along the axis of mating or couplings while restricting any movement transverse to the mating axis. Nipples 253 and 255 extend through bracket 257 which is mounted to a lateral wall of a bracket 261 extending from the lower surface 259 of the upper ramp 150.

As illustrated in FIG. 10, the elastomeric bushings 245 between the bracket 257 and the nipples 253 and 255 allow the nipples 253 and 255 and the housing 251 to move transverse to the mating axis while limiting any movement along the mating axis. This allows angular alignment during coupling. With the front retaining ring 247 being displaced from the bracket 257 and the rear retaining ring 249 being in contact with the bracket 257 this allows a minimum of rearward movement to accommodate severe forces during over travel. An alignment pin 271 on coupler 250 is received in an alignment aperture 270 on coupler 251 as the couplers are mated. Thus for example, for any misalignment of approximately one-half inch the pin 271 will ride into aperture 273 to align the couplers 250 and 251. Any misalignment is accommodated by the elastic bushings 245 while the over travel and coupling mating forces are absorbed by spring 258 and the movement along the mating axis provided by bushings 246.

Details of the fluid coupler 234 is illustrated in the cross section of FIG. 10. The housings 250 and 251 each include a main reservoir passage 260 having main reservoir pipe nipples 252 and 253 connected to a main reservoir pipe port. The housings 250 and 251 also include a passage 262 having the nipples 254 and 255 connected to a brake pipe port therein. A coupling member 264 extends from the passages 260 and 262 of the first housing 250 at a respective main reservoir and brake coupling port and mates with coupler 265 extending from passage 260 and 262 at the corresponding port of the second housing 251. Nut 266 is threadably received in the coupling ports of housing 250 and 251 and retain the coupling members 264 and 265 therein. The couplings 264 and 265 slide with respect to the nut 266 and the housing portions 250 and 251.

A valve actuator 268 is connected to the coupling members 264 and 265 and extends into the passages 260 and 262. A spring 270 between the brake pipe nipples 254/255 and couplers 264/265 in the brake pipe coupling port bias the couplers towards each other. The main reservoir passages 260 each includes a valving element including a valve seat 272 and a valving element 274. A spring 276, extending from spring cage 278 connecting to the main reservoir nipples 252 and 253, biases the valving element 254 on to the valve seat 272. Spring 276 not only maintains the valve closed, but also provides the resilient mounting through actuator 268 of the coupling members 264 and 265 in the main reservoir coupling port.

The springs 270 and 276 maintain the coupling elements 264 and 265 extending from their housings 250 and 251 as well as keeping the valve element 274 on seat 272 when the housing portions 250 and 251 are substantially displaced. When the tongue 120 enters and is locked in the locking area 170, the coupling elements 264 and 265 are engaged and recessed within the passages 260 and 262. The recessed coupling 264 and 265 in passages 260 will move the valve element 274 off valve seat 272 opening the valve. This will connect the main reservoir pipe through the coupling. The valving elements 274 on seat 272 is considered a check or a poppet valve. There is no valve structure in the brake pipe coupling since the control of the individual portions of the brake pipe is under electric control as described in U.S. Pat. No. 5,222,443. As can be seen, once the couplers disengage or are no longer joined, the valve element 274 rest on valve seat 272 preventing the dissipation of the main reservoir pipe in the respective halves of the train.

The electrical interconnections illustrated in FIG. 11 includes coupling elements 280 and 281 connected to the electrical cable 82L and 82U respectively by conduits 282 and 283. Conduit 282 extends through bracket 284 which mounts it to wall 127 of the lower ramp 100. The coupler 280 and conduit 282 ride on bushings 297 in bracket 284 and guide 290 and are biased to an extended position by spring 286 along the mating axis while restricting any transverse movement. A nut 288 on conduit 282 engages the rear of bracket 284 to limit the extension of coupler 280. Conduit 283 extends through bracket 285 which mounts it to a side wall of another housing 261 extending from the surface 259 of the upper deck 150. Elastomeric bushings 287 mount conduit 283 and coupling element 281 to bracket 285 so as to allow movement of the conduit 283 and coupling element 281 transverse to the mating axis. This allows angular adjustment during coupling. While retaining ring 289 is mounted engaging bracket 285, retaining ring 291 is mounted spaced from bracket 285 to allow limited movement along the mating axis. Alignment pins 293 extending from coupling 281 are received in alignment apertures 294 of coupler 280. As with the fluid coupler, the electrical coupling element 280 is extended when the ramps are displaced and the coupling elements 280 and 281 engage each other and move back into bracket 284 to couple the electrical contacts, not shown, when the tongue 120 is locked within the locking area 170 of the upper ramp 150. This is an automatic coupling and decoupling and align as described for fluid coupling.

As illustrated in FIGS. 9 and 11, a shock absorbing element 295 is mounted by bracket 297 to the surface 259 of the upper ramp 150. A stop plate 296 is mounted to walls 129 and 127 respectively of the lower ramp 100. Thus, as the tongue 120 of the lower ramp enters the locking area 170, the stop plates 296 will engage the shock absorbers 295 to allow over travel and prevent any damage due to over insertion. This is in addition to the resiliency of the couplers 234.

The operation of the ramp car is described in U.S. Pat. No. 5,222,443. The present lock and coupler provide improvements to the ramp car disclosed therein.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A train including a plurality of rail cars and a ramp car, a main reservoir pipe and a brake pipe running through each car, said ramp car including first and second car portions coupled in a travel condition and separated in a loading condition, said ramp car including fluid coupling means for coupling first portions of said main reservoir and brake pipes on said first car portion to second portions of said main reservoir and brake pipes on said second car portion when said car is in said travel condition, said fluid coupling means comprising:

first and second housings connected to said first and second car portions respectively;

a main reservoir pipe port and brake pipe port in each housing each connected to a respective main reservoir pipe and brake pipe portion;

a main reservoir coupling port and brake coupling port in each housing each connected by a passage to a respective main reservoir pipe port and brake pipe port;

valve means in each of said main reservoir passages for automatically closing said main reservoir passages when said first and second housings are separated and automatically opening said main reservoir passages when said first and second housings are joined.

2. A train according to claim 1 wherein said valve means each include an actuator responsive to the relative positions of said first and second housings for controlling opening and closing of said valve means.

3. A train according to claim 2 wherein said valve means each include a check valve opened by said actuator.

4. A train according to claim 2 wherein said valve means each include a poppet valve opened by said actuator.

5. A train according to claim 2 wherein said main reservoir coupling ports each include a coupler resiliently mounted therein for mating with a respective coupler and wherein said actuator is connected to said coupler.

6. A train according to claim 5 wherein said valve means includes a spring for closing said valve means and forming part of said resilient mounting of said coupler and wherein said actuator opens said valve means.

7. A train according to claim 1 wherein said main reservoir coupling ports and said brake coupling ports each include a coupler resiliently mounted therein for mating with a respective coupler.

8. A train according to claim 7 wherein said valve means each include an actuator connected to a respective main reservoir coupler for controlling opening and closing of said valve means in response to the position of said main reservoir coupler in said main reservoir coupling port.

9. A train according to claim 1 wherein said fluid coupling means includes:

alignment means for aligning said first and second housings during mating along a mating axis;

first means for mounting said first housing to said first car portion and allowing movement of said first housing along said mating axis; and second means for mounting said second housing to said second car portion and allowing movement of said second housing transverse to said mating axis to facilitate alignment.

10. A train according to claim 9 wherein said first means allows overtravel during mating and absorption of some mating forces; and said second means allows angular movent to facilitate alignment.

11. A train according to claim 1 wherein said train includes an electric cable running through each car; and wherein said ramp car includes electrical coupling means for automatically coupling first portions of said electrical cable on said first car portion to second portions of said electrical cable on said second car portion when said ramp car is in said travel condition.

12. A train including a plurality of rail cars and a ramp car, an electric cable running through each car, said ramp car including first and second car portions coupled in a travel condition and separated in a loading condition, said ramp car including electrical coupling means for coupling a first portion of said electric cable on said first car portion to a second portion of said electric cable on said second car portion when said car is in said travel condition, said electric coupling means comprising:

first and second housings having mating electrical connectors;

alignment means for aligning said first and second housings during mating along a mating axis;

first means for mounting said first housing to said first car portion and allowing movement of said first housing along said mating axis; and second means for mounting said second housing to said second car portion and allowing movement of said second housing transverse to said mating axis to facilitate alignment.

13. A train according to claim 12 wherein said train includes at least one fluid pipe running through each car; and wherein said ramp car includes fluid coupling means for automatically coupling a first portion of said fluid pipe on said first car portion to a second portion of said fluid pipe on said second car portion when said ramp car is in said travel condition, said fluid coupling comprising first and second fluid housings having mating fluid connectors;

alignment means for aligning said first and second fluid housings during mating along said mating axis;

third means for mounting said first fluid housing to said first car portion and allowing movement of said first fluid housing along said mating axis; and fourth means for mounting said second fluid housing to said second car portion and allowing movement of said second fluid housing transverse to said mating axis to facilitate alignment.

14. A train according to claim 12 wherein said first means allows overtravel during mating and absorption of some mating forces; and said second means allows angular movent to facilitate alignment.

* * * * *